US009114514B2

(12) United States Patent
Leong et al.

(10) Patent No.: US 9,114,514 B2
(45) Date of Patent: Aug. 25, 2015

(54) ROTARY POWER TOOL OPERABLE IN EITHER AN IMPACT MODE OR A DRILL MODE

(75) Inventors: Chi Hoe Leong, Bayan Lepas (MY); Mohsein Wan, Penang (MY); Siew Yuen Lee, Penang (MY); Manfred Lutz, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1029 days.

(21) Appl. No.: 12/528,110

(22) PCT Filed: Dec. 4, 2007

(86) PCT No.: PCT/EP2007/063286

§ 371 (c)(1),
(2), (4) Date: Sep. 16, 2010

(87) PCT Pub. No.: WO2008/101556

PCT Pub. Date: Aug. 28, 2008

(65) Prior Publication Data

US 2010/0326686 A1 Dec. 30, 2010

(30) Foreign Application Priority Data

Feb. 23, 2007 (EP) ..... 07102959

(51) Int. Cl.

| | |
|---|---|
| ***E02D 7/02*** | (2006.01) |
| ***B25B 21/02*** | (2006.01) |
| ***B25B 21/00*** | (2006.01) |

(52) U.S. Cl.

CPC ..... *B25B 21/026* (2013.01); *B25B 21/00* (2013.01)

(58) Field of Classification Search

CPC ..... B25B 21/026; B25B 23/1475; B25B 23/1405; B25B 23/14; B25B 45/16; B25F 5/00; B25F 5/001

USPC ..... 173/46–48, 93.5–93.7, 109, 202, 203, 173/205

See application file for complete search history.

(56) References Cited

U.S. PATENT DOCUMENTS

| | | | | |
|---|---|---|---|---|
| 3,414,066 | A * | 12/1968 | Wallace | 173/93.6 |
| 3,727,432 | A * | 4/1973 | Eaves et al. | 464/35 |
| 4,157,120 | A | 6/1979 | Anderson | |
| 4,232,749 | A | 11/1980 | Rohrbach | |
| 4,284,148 | A * | 8/1981 | Wanner et al. | 173/109 |
| 4,502,824 | A * | 3/1985 | Dohse et al. | 409/234 |
| 4,824,298 | A * | 4/1989 | Lippacher et al. | 408/240 |

(Continued)

FOREIGN PATENT DOCUMENTS

| | | |
|---|---|---|
| EP | 0 321 594 | 6/1989 |
| EP | 1 762 343 | 3/2007 |

(Continued)

*Primary Examiner* — Robert Long
(74) *Attorney, Agent, or Firm* — Kenyon & Kenyon LLP

(57) ABSTRACT

A rotary power tool operable in either an impact mode or a drill mode comprising a driveshaft (10), an output shaft (32), a hammer (18) coupled to the driveshaft (10) for transmitting torque to the output shaft (32), and a blocking member (40, 74) which is in a first position wherein it blocks the hammer (18) from moving axially along the rotational axis (37) of the tool when the power tool operates in the drill mode and is in a second position wherein it allows the hammer (18) to move axially along the rotational axis (37) of the tool when the power tool operates in the impact mode, wherein the blocking member (40, 74) is supported by the driveshaft (10).

19 Claims, 10 Drawing Sheets

(56) References Cited

U.S. PATENT DOCUMENTS

| | | | | |
|---|---|---|---|---|
| 5,025,869 | A * | 6/1991 | Terunuma et al. | 173/98 |
| 5,199,505 | A * | 4/1993 | Izumisawa | 173/93.6 |
| 5,343,961 | A * | 9/1994 | Ichikawa | 173/48 |
| 5,601,149 | A | 2/1997 | Kawasaki et al. | |
| 5,673,758 | A * | 10/1997 | Sasaki et al. | 173/178 |
| 5,951,026 | A * | 9/1999 | Harman et al. | 279/143 |
| 5,971,403 | A * | 10/1999 | Yahagi et al. | 279/19.3 |
| 5,992,538 | A * | 11/1999 | Marcengill et al. | 173/93 |
| 6,213,222 | B1 * | 4/2001 | Banach | 173/1 |
| 6,241,026 | B1 * | 6/2001 | Wache et al. | 173/132 |
| 6,457,535 | B1 * | 10/2002 | Tanaka | 173/48 |
| 6,971,455 | B2 * | 12/2005 | Shibata et al. | 173/48 |
| 7,124,839 | B2 * | 10/2006 | Furuta et al. | 173/104 |
| 7,131,503 | B2 | 11/2006 | Furuta et al. | |
| 7,308,948 | B2 * | 12/2007 | Furuta | 173/48 |
| 7,673,702 | B2 * | 3/2010 | Johnson et al. | 173/93 |
| 8,136,607 | B2 * | 3/2012 | Frauhammer et al. | 173/104 |
| 2006/0024141 | A1 * | 2/2006 | Schad | 408/8 |
| 2006/0180327 | A1 | 8/2006 | Nagasaka et al. | |
| 2006/0237205 | A1 * | 10/2006 | Sia et al. | 173/48 |
| 2007/0056756 | A1 * | 3/2007 | Chung et al. | 173/48 |
| 2007/0181319 | A1 * | 8/2007 | Whitmine et al. | 173/48 |
| 2008/0167158 | A1 * | 7/2008 | Chen | 475/298 |
| 2010/0000749 | A1 * | 1/2010 | Andel | 173/48 |
| 2010/0276168 | A1 * | 11/2010 | Murthy et al. | 173/93.5 |
| 2012/0322605 | A1 * | 12/2012 | Hirabayashi | 475/149 |
| 2013/0112448 | A1 * | 5/2013 | Profunser et al. | 173/93.5 |
| 2013/0255982 | A1 * | 10/2013 | Takahashi et al. | 173/47 |
| 2013/0333910 | A1 * | 12/2013 | Tanimoto et al. | 173/176 |
| 2014/0102741 | A1 * | 4/2014 | Sekino et al. | 173/181 |

FOREIGN PATENT DOCUMENTS

| | | |
|---|---|---|
| JP | 2-139182 | 5/1990 |
| JP | 2001/009746 | 1/2001 |
| JP | 2001-501877 | 2/2001 |
| JP | 2001-88051 | 4/2001 |
| JP | 2001-88052 | 4/2001 |
| JP | 2003-220569 | 8/2003 |
| JP | 2005-219139 | 8/2005 |
| JP | 2005-254374 | 9/2005 |
| WO | 99/07521 | 2/1999 |

* cited by examiner

ROTARY POWER TOOL OPERABLE IN EITHER AN IMPACT MODE OR A DRILL MODE

CROSS-REFERENCE

The invention described and claimed hereinbelow is also described in PCT/EP2007/063286, filed on Dec. 4, 2007 and EP 07102959.9, filed on Feb. 23, 2007. This European Patent Application, whose subject matter is incorporated here by reference, provides the basis for a claim of priority of invention under 35 U.S.C. 119 (a)-(d).

BACKGROUND OF THE INVENTION

The present invention relates to impact drivers, a category of rotary power tools intended for use in high torque driving applications. Pulses of torque are generated in such tools via a hammer and anvil arrangement mounted between the driveshaft and output shaft.

A typical arrangement is shown in US Patent Publication No. 2006/0237205 A1. A driveshaft is coupled to a hammer so that rotation of the driveshaft normally rotates the hammer. The hammer contacts an anvil that is integral with an output shaft. When the output shaft encounters little resistance, the anvil rotates along with the hammer. When high resistance to rotation is encountered, the anvil may slow or halt altogether. However the coupling of the hammer to the driveshaft is such that the hammer will repeatedly draw away from the anvil and then spin forward with increased velocity to strike the anvil and provide a pulse of torque, this impact occurring as many as two times per revolution of the driveshaft.

Because it may damage screws or bits not intended for bursts of high torque, an impact driver is generally considered undesirable for low torque applications, and a typical user may be obliged to carry with him a more conventional drill for these purposes. Since the devices operate so similarly, it may seem especially undesirable that one should have to purchase, maintain, and make use of two distinct tools where one might suffice. As such, multifunction drivers which provide different operational modes have become common. A disadvantage of existing hybrid designs is that they are bulky and/or heavy since the housing must accommodate means for achieving all modes.

SUMMARY OF THE INVENTION

It is therefore an object of the present invention to provide a rotary power tool operable in either an impact mode or a drill mode which avoids the disadvantages of the prior art. The inventive rotary tool provides for a blocking member that is in either a first position wherein it blocks a hammer from moving axially along the rotational axis of the tool or a second position wherein it allows the hammer to move axially along the rotational axis of the tool and this determines whether the tool operates in drill mode or impact mode. Since the blocking member is supported by the driveshaft, the inventive rotary tool has the advantage that the blocking member can be quite compact versus the prior art, requiring little enlargement of the gearbox case and allowing a more compact overall housing for the tool. It is also advantageous that the blocking member is potentially lighter than prior art solutions and therefore may provide little additional weight to the tool.

The blocking member may move between the first and second positions by either moving axially or radially relative to the driveshaft. In certain cases, the blocking member may be arranged within a radial cavity in the driveshaft. Arranging the blocking member in a radial cavity of the driveshaft has the further advantage that the driveshaft can help support the axial load encountered by the blocking member, thereby requiring no additional design elements to be included for providing this function. These are simpler and more compact ways for determining the mode of operation of the tool than providing separate coaxial driveshafts for operating the tool in the different respective modes.

That the blocking member can be retained by a portion of the hammer rather than using an additional part or structure is a simple and cost-effective solution since no additional means for retaining the blocking member need to be constructed or positioned.

Adjustment of the position of the blocking member can be accomplished by movement of a sliding member which travels within an axial cavity in the driveshaft. This is advantageous since this arrangement requires no additional space in the tool for accommodating the sliding member. Compared to a solid driveshaft, the tool may advantageously be lighter than an alternative solution. Furthermore a recess in the same sliding member provides a simple and inexpensive way for the sliding member to interact with the blocking member so as to determine whether the blocking member is in a first position or a second position.

It is a simple solution to determine whether the sliding member is in the first or second sliding position by default by providing a biasing member to interact with the sliding member. For user-adjustment of the sliding member away from its default position, the tool is advantageously provided with an adjustment member, for example a rotatable sleeve, which the user can intuitively use to select between different positions of the sliding member and therefore different modes of operation. As such the user can adjust the modes without disassembling the tool. It is simpler and more economical to combine the mode-selection function provided by the rotatable sleeve with other functions, such as adjustment of the rotational speed of the driveshaft.

The mode switching function can also be embodied in a standalone attachment for a power tool. The user can advantageously use such an attachment on a rotary tool that does not have the impact function and still retain the conventional drill function without removing the attachment.

DESCRIPTION OF THE PREFERRED EMBODIMENTS

Figure 1:
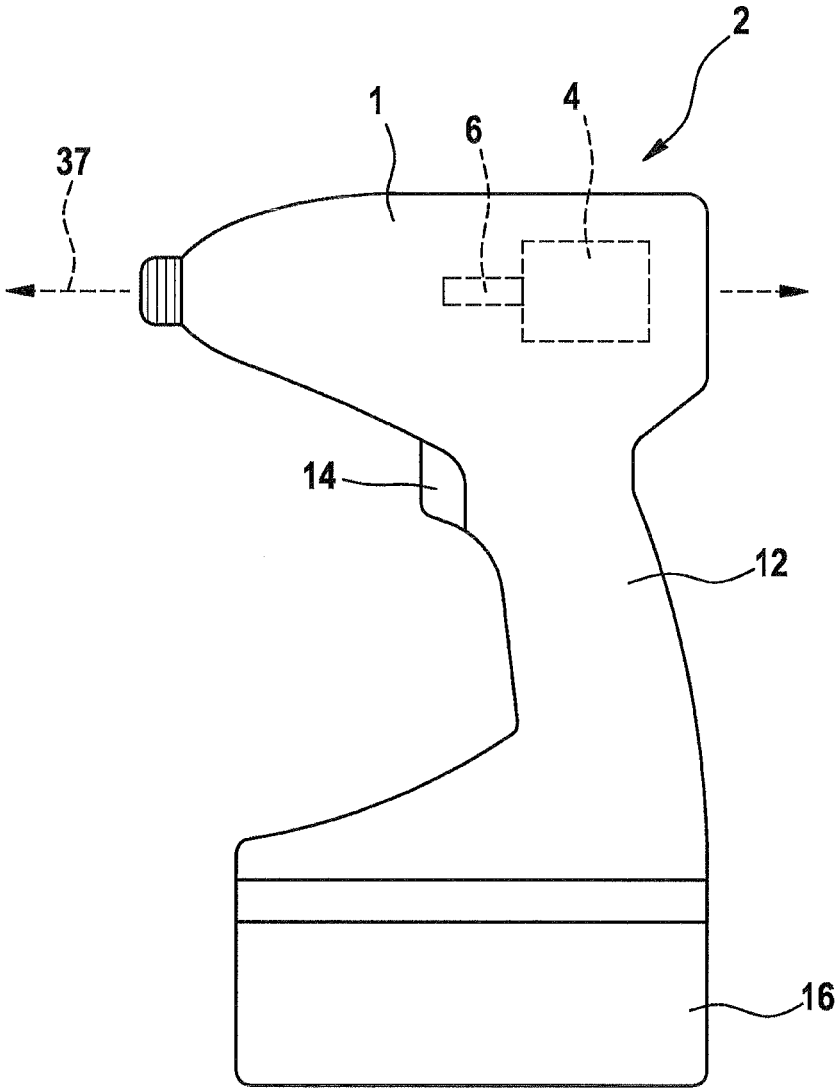
FIG. 1 is a schematic drawing of a side view of an impact driver according to the present invention.

An example of a rotary tool according to the present invention is illustrated in FIG. 1. Within a housing 1 of an impact driver 2 is a motor 4 and an associated motor shaft 6. Rotation of the motor shaft 6 is transduced via various step down planetary gears in a gearbox 8 to rotate a driveshaft 10. The tool is provided with a handle 12 and a trigger 14 so that it may be conveniently operated by a user. A battery 16 provides a DC power source but an AC power source is a standard alternative.

Figure 3:
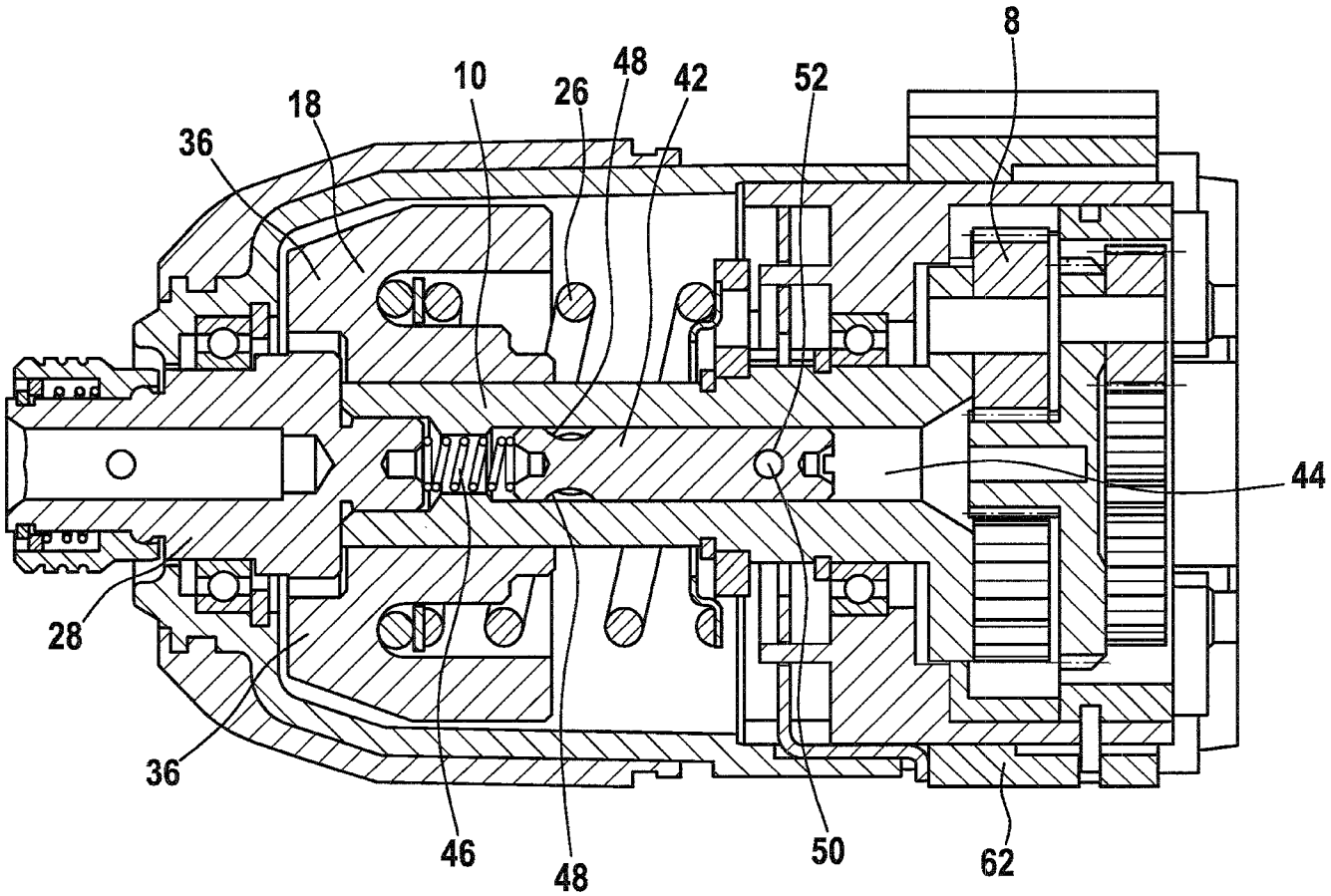
FIG. 3 is a section view of a part of an impact driver in impact mode taken along section line A-A of FIG. 2.
Figure 4:
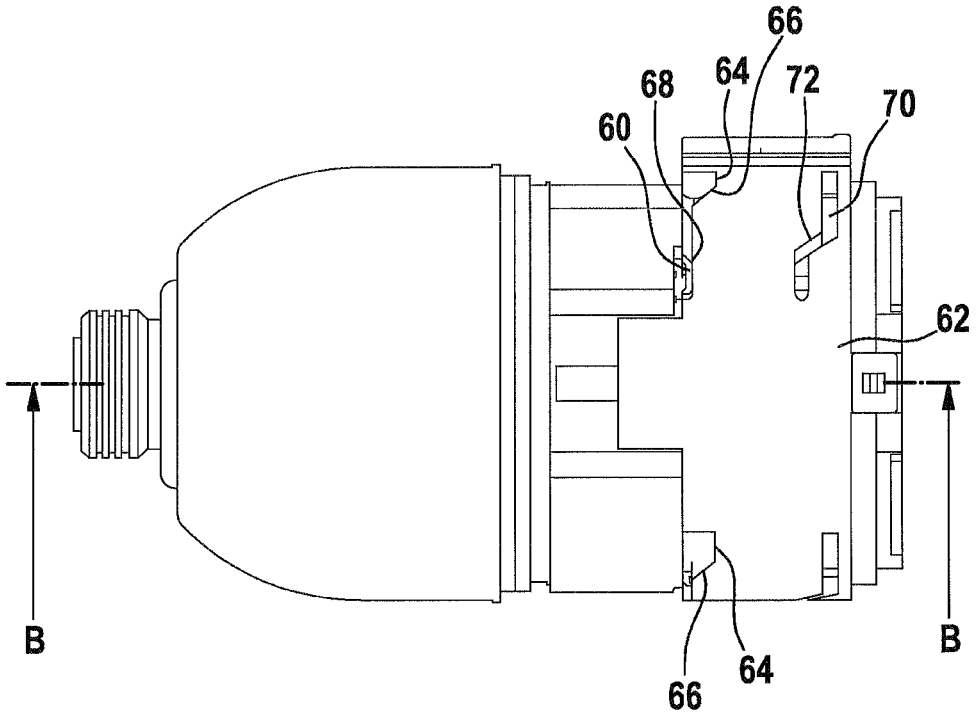
FIG. 4 is a side view of a part of the housing of an impact driver in impact mode.

While still further modes are possible, the impact driver 2 may operate in at least two different modes: impact mode and drill mode. In impact mode, the tool operates as is customary for an impact driver, providing intermittent impacts to the output shaft when high torque is required. As will be described in the subsequent description, in drill mode the impact function is disabled and the tool operates much like a standard drill/driver. A comparable impact driver 2 representing the preferred embodiment is shown in FIGS. 2-4 and is configured for operation in impact mode.

Figure 2:
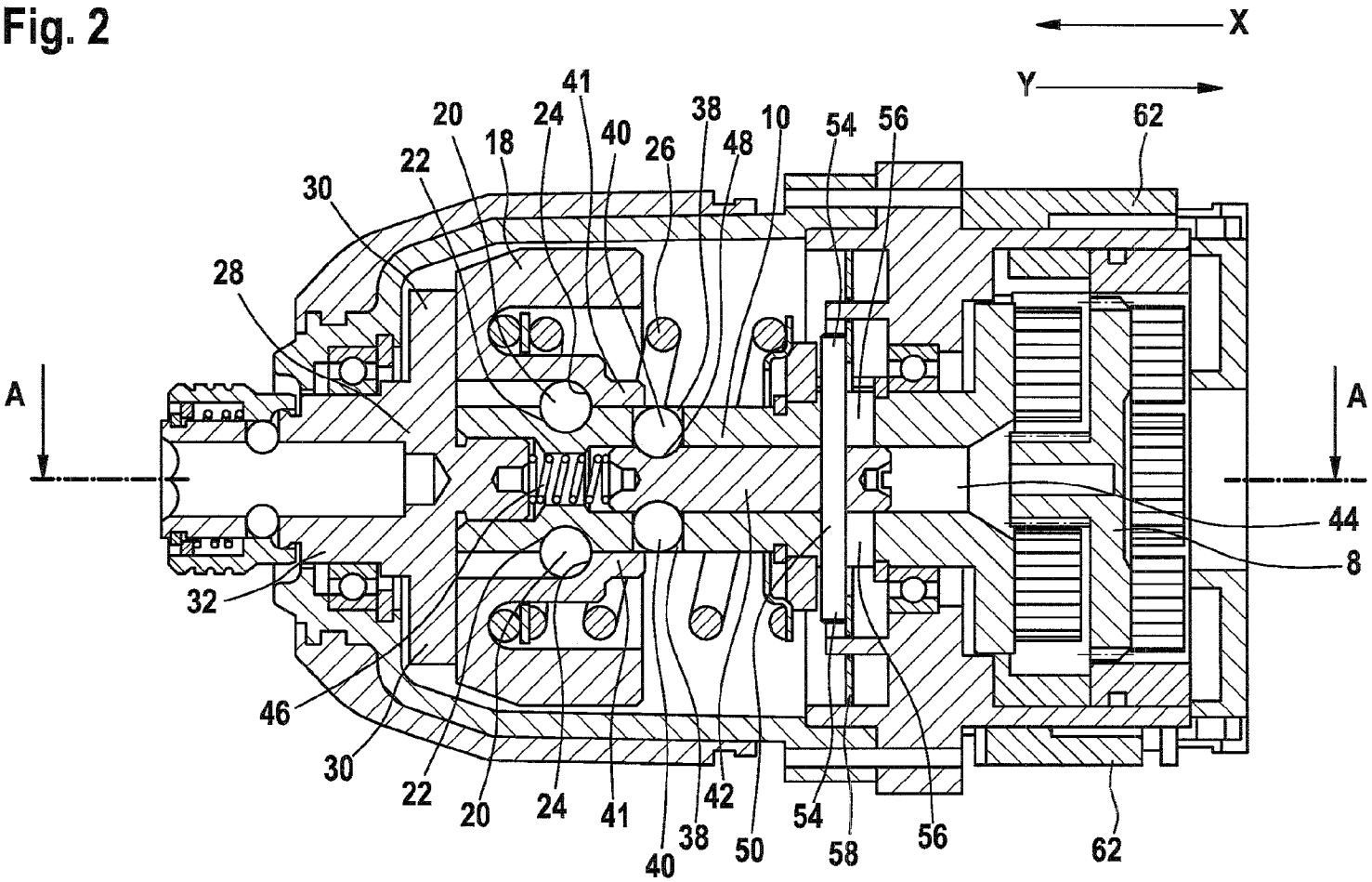
FIG. 2 is a section view of a part of an impact driver in impact mode taken along section line B-B of FIG. 4.
Figure 5:
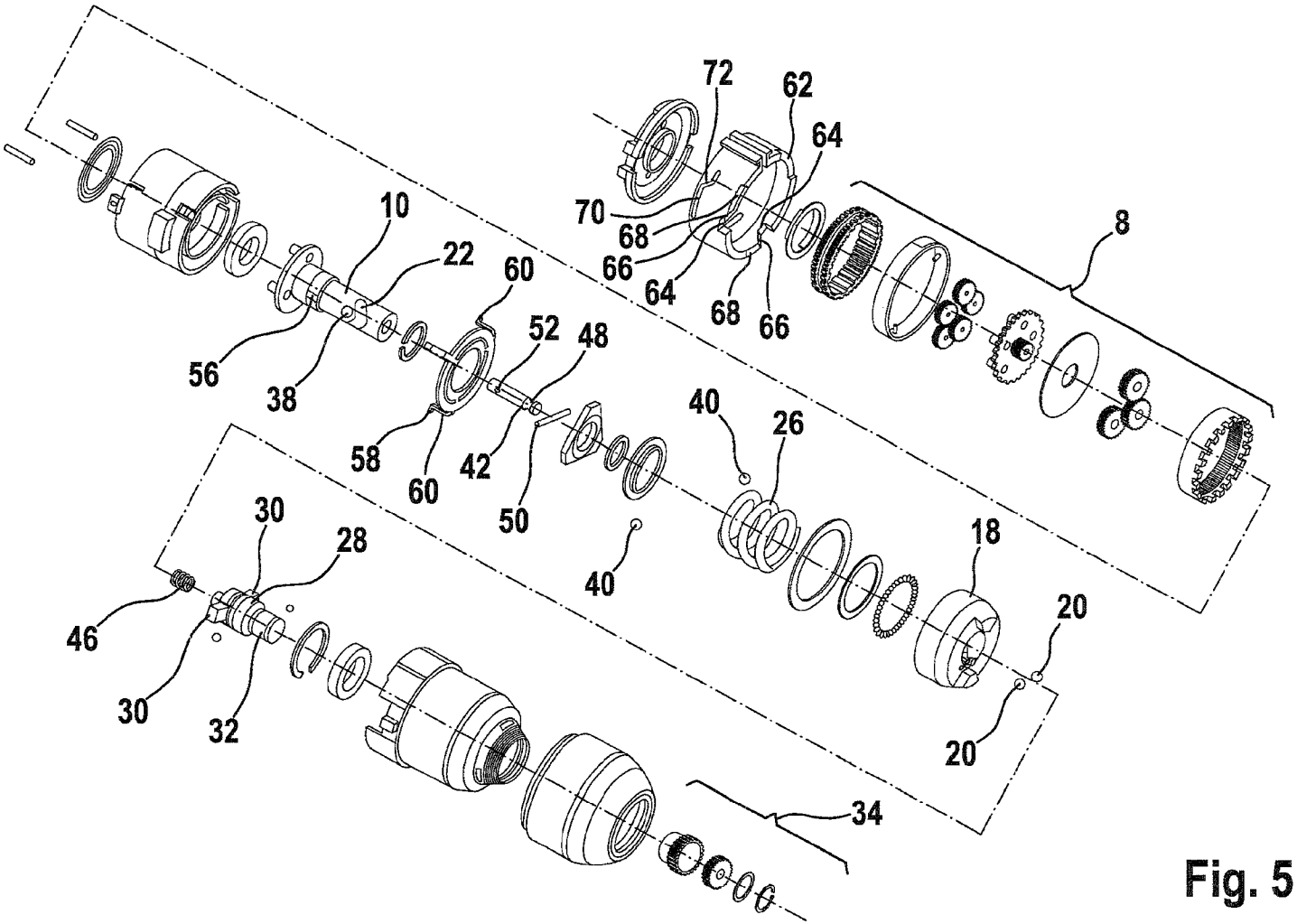
FIG. 5 is an exploded perspective view of an inner mechanism of an impact driver.

The section view of FIG. 2 shows the inner workings of the impact driver 2. The driveshaft 10 is coupled but not directly attached to a hammer 18, in so far as movements of the driveshaft 10 translate through two balls 20 to move the hammer 18. Other couplings are possible, so long as they permit the hammer 18 to provide the impact function as will be described. Each of the two balls 20 is seated in one of two V-shaped grooves 22 (seen best in FIG. 5) that are present in the driveshaft 10 and each also cooperates with one of two corresponding inner cam surfaces 24 in the hammer 18. These inner cam surfaces 24 are also V-shaped, with the "V" oriented in a direction opposite the "V" of the V-shaped grooves 22. Since the hammer 18 is biased by a spring 26 in direction indicated by arrow X of FIG. 2, each ball 20 is wedged by the groove 22 against the inner cam surface 24, so that the driveshaft 10 and hammer 18 are effectively coupled. When there are low torque requirements, rotation of the driveshaft 10 translates directly to rotation of the hammer 18.

Downstream of the hammer 18 is an anvil 28 which includes two arms 30 and a contiguous output shaft 32. The output shaft 32 is intended to protrude from the working end of the tool and may be provided with any number of coupling elements (shown generally at 34) as means for securing drill bits or socket wrenches or the like. Under conditions of minimal resistance to rotation, each of two protrusions 36 on the hammer 18 is positioned adjacent an anvil arm 30 where it may transmit a torque so that the anvil 28 and therefore the output shaft 32 rotate when the hammer 18 rotates. However, when higher resistance is encountered, for example when driving a wood screw or when loosening a frozen bolt, rotation of the anvil 28 may slow down or halt altogether.

If the torque required to move the anvil 28 exceeds the spring force on the hammer 18, rotation of the driveshaft 10 will cause the balls 20 to move in the V-shaped grooves 22, this movement providing cam action on the inner cam surfaces 24 of the hammer 18. As such, the hammer 18 moves axially in direction Y of FIG. 2 along the rotational axis 37 of the tool against the force of the spring 26.

Since the anvil 28 cannot move axially, this movement causes the protrusions 36 to clear the anvil arms 30, so that the hammer 18 is once again free to rotate. The force of the spring 26 and the torque from the driveshaft 10 accelerate the hammer 18 axially and rotationally. Guided partially by the coupling of the hammer 18 with the balls 20 which are travelling in the V-shaped grooves 22, each protrusion 36 of the hammer 18 strikes the anvil arm 30 opposite the one from which it had just disengaged. The mass of the accelerating hammer 18 provides a pulse of elevated torque to the anvil 28 to overcome the resistance. If the output shaft 32 still does not turn, the process repeats twice per revolution of the driveshaft 10.

The V-shaped grooves 22 are positioned so that their shape is symmetrical with respect to the rotational axis 37 of the tool, so that the impact mode may operate similarly irrespective of the direction in which the driveshaft 10 is turning, thereby enabling the tool to be useful both for tightening and loosening when high torque is required.

The driveshaft 10 is provided with paired radial cavities 38 into which are arranged balls 40. Two cavities 38 and two balls 40 are preferred, but combinations of one, three, four or more cavities 38 and balls 40 are also possible, as long as the perforation of the driveshaft 10 by the cavities does not compromise its structural integrity. In all cases it is preferable if the cavities 38 and balls 40 are symmetrically arranged around the circumference of the driveshaft 10.

Figure 6:
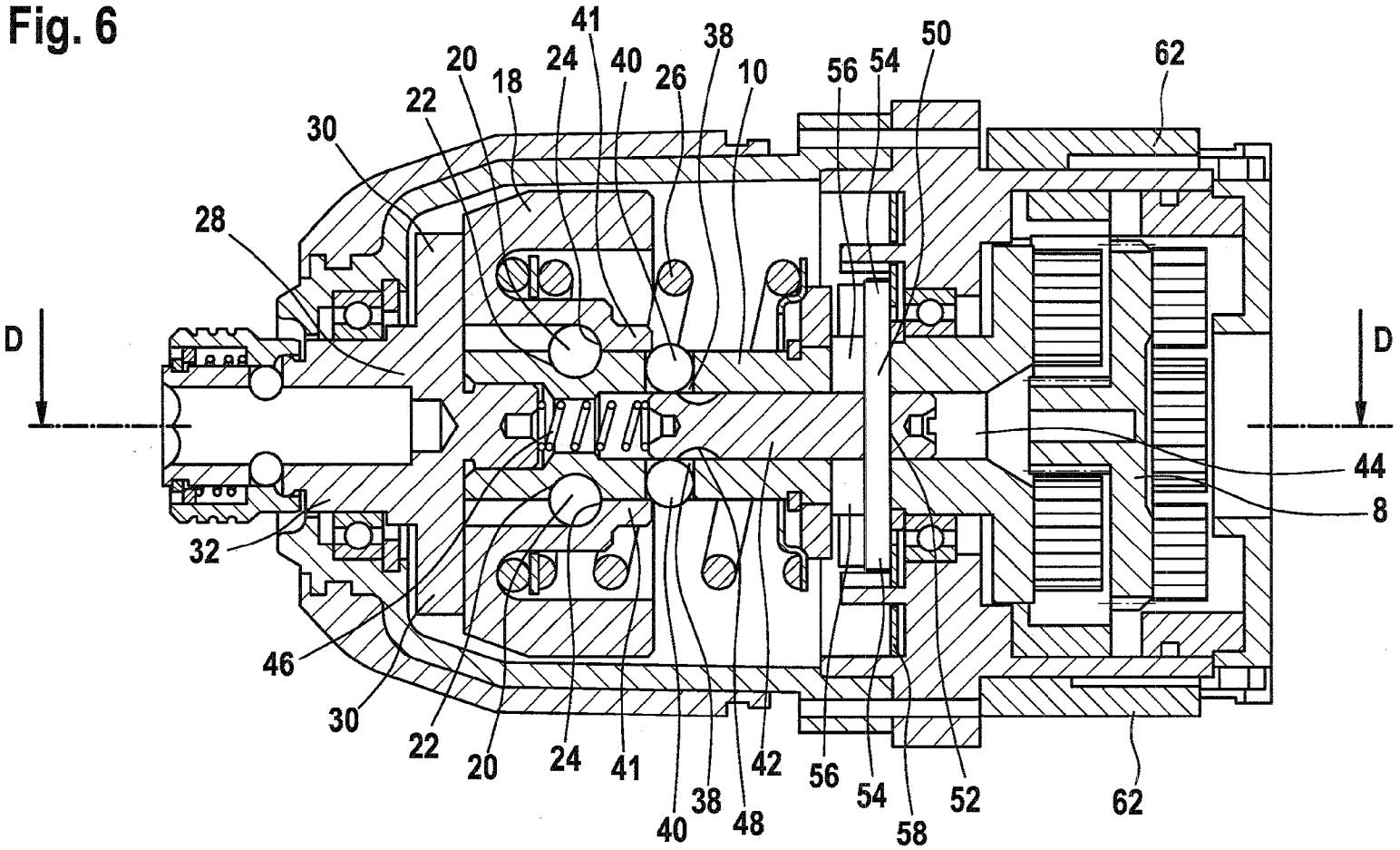
FIG. 6 is a section view of a part of an impact driver in drill mode taken along section line C-C of FIG. 8.
Figure 7:
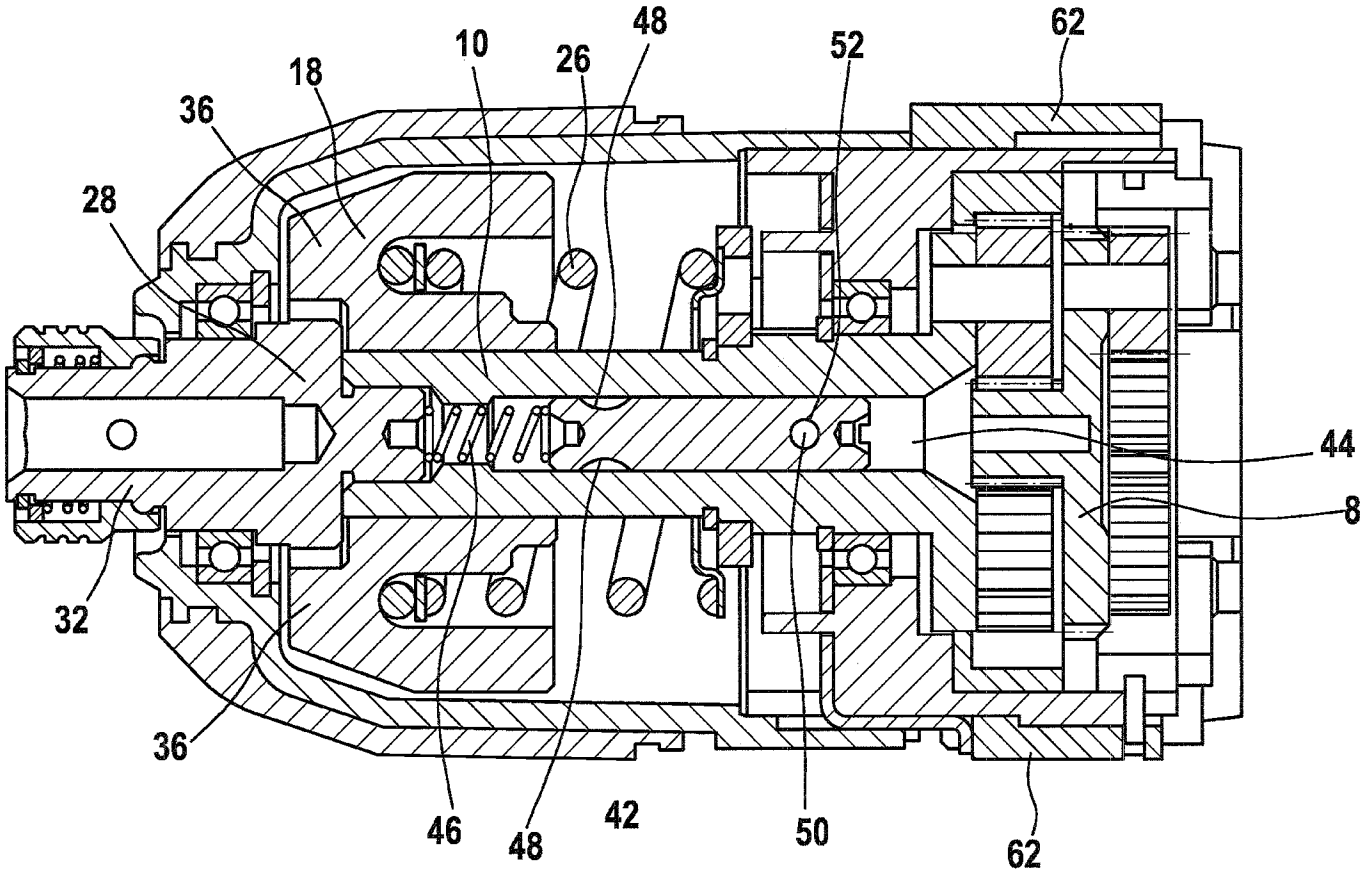
FIG. 7 is a section view of a part of an impact driver in drill mode taken along section line D-D of FIG. 6.
Figure 8:
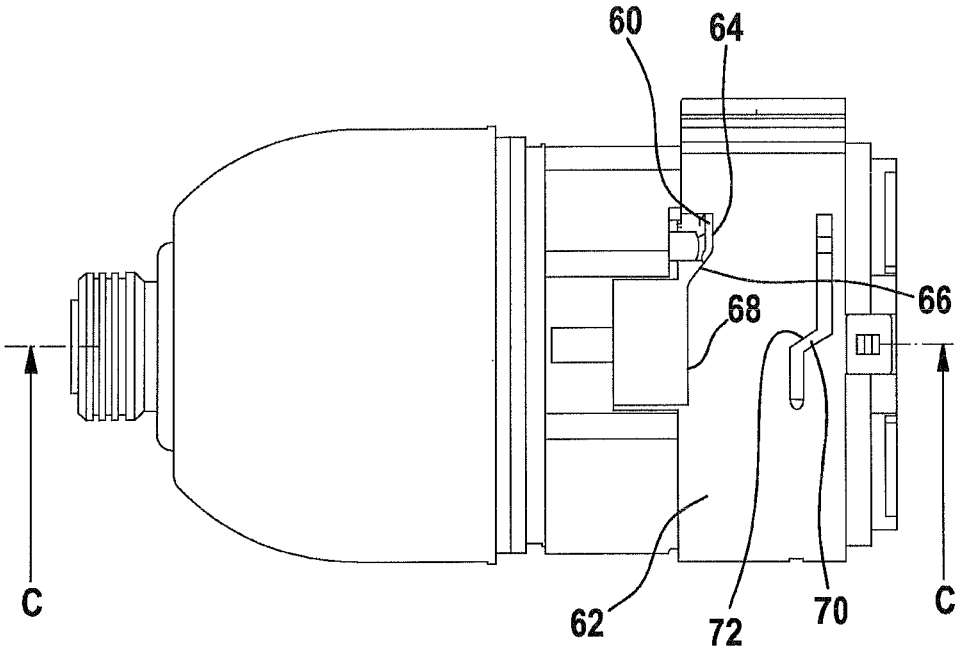
FIG. 8 is a side view of a part of the housing of an impact driver in drill mode.

The impact driver 2 as shown in FIGS. 6-8 is configured for operation in drill mode. As illustrated best in FIG. 6, the balls 40 act as blocking members when the impact driver is in drill mode. Since the balls 40 extend outside of the diameter of the driveshaft 10, the hammer 18 can no longer move axially in direction Y along the rotational axis 37 of the tool, and as such the impact mechanism is disabled. Note that this blocking mechanism is robust since the balls 40 are supported axially by the walls of the radial cavities 38 in the driveshaft 10 and therefore can sustain the high axial load presented by the hammer 18.

In both impact mode (FIG. 2) and in drill mode (FIG. 6), a rear portion 41 of the inner perimeter of the hammer 18 extends into the areas extending radially from the radial cavities 28, effectively retaining the balls 40. Alternatively the driveshaft 10 could be provided with a cage structure so as to retain the balls 40. At the other end of each radial cavity 38, each ball 40 is retained by a sliding member 42 which is able to move within an axial cavity 44 in the driveshaft 10. At one end of the axial cavity 44, there is a spring 46 which acts as a biasing member to urge the sliding member 42 in direction Y. This biasing force might alternatively be provided by a piece of elastomeric material.

The cross-sectional shape of the axial cavity 44 is not critical to its function, and so it might be either polygonal or circular in cross-section, although an overall cylindrical shape is preferred. The sliding member 42 may also be polygonal or circular in cross section, but the preferred shape is also cylindrical, so that absent other connections it would be free to rotate as well as slide within the axial cavity 44. The general cross sectional shape of the axial cavity 44 and the sliding member 42 should preferably be substantially similar, so that the sliding member 42 is free to slide axially within the axial cavity 44 with minimal frictional resistance. The relative widths should also be matched closely so that the sliding member 42 will not vary from a general axial orientation.

While the dimensions of the preferred sliding member 42 are such that it is longer in the axial direction than in the radial direction, other dimensions and shapes are possible, so long as the structural aspects provided in the description below are accommodated by the sliding member 42.

The sliding member 42 is provided with a circumferential groove 48 that is complementary in shape to the balls 40. When the tool is operating in impact mode (FIGS. 2-4) each ball 40 is received by the groove 48 and therefore is able to be fully accommodated within the diameter of the driveshaft 10. As such, the hammer 18 is permitted to move in direction Y. As will be described, relative to its position in drill mode, each ball 40 has moved radially relative to the driveshaft 10 and this is possible when means for adjusting the sliding member 42 have been engaged which overcome the biasing force of the spring 46 on the sliding member 42.

While a circumferential groove 48 is preferred, the sliding member 42 can alternatively be provided with one or more recesses. These may be individual recesses each intended for mating individually with one ball 40 or there may be one or more larger recesses which are capable of accommodating more than one ball 40. The groove 48 can be thought of as providing one or more recesses for receiving one or more balls 40. But it has the further advantage that a recess is present for receiving a ball 40 irrespective of any axial rotation of the sliding member 42 with respect to the radial cavities 38. However, in alternative embodiments where the sliding member is not free to rotate in this way, isolated recesses provide reasonable alternatives to the circumferential groove 48.

Figure 9:
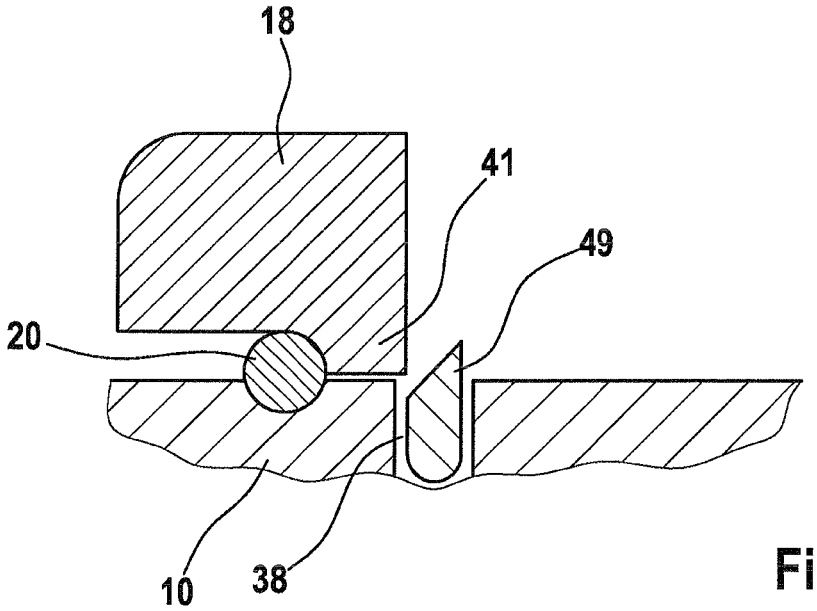
FIG. 9 is a schematic view of an alternative embodiment for an impact driver comparable to the section view of FIG. 6.
Figure 10:
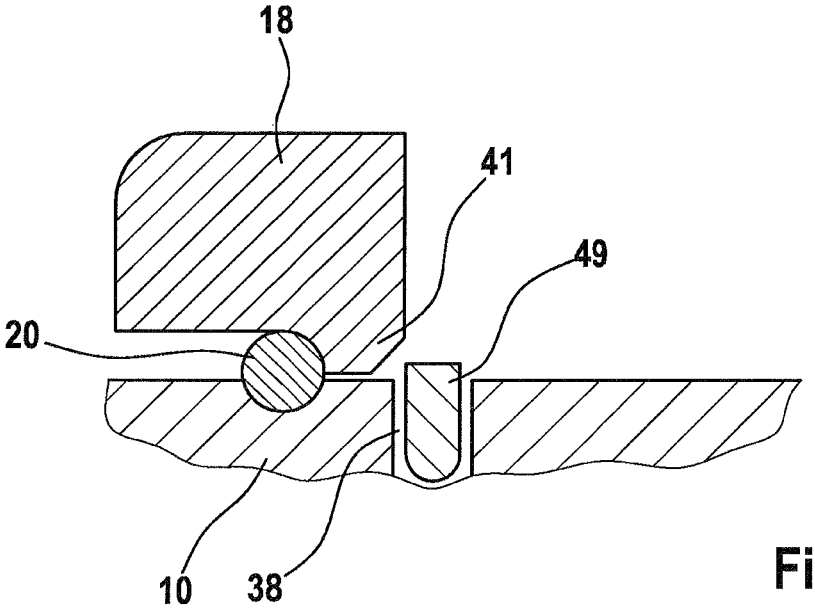
FIG. 10 is a schematic view of another alternative embodiment for an impact driver comparable to the section view of FIG. 6.

While the preferred shape of the blocking member is a ball 40 which may interact with a groove 48 in the sliding member 42, other pairs of complementary shapes are possible. The blocking members can also be a cube, cylinder, a rectangular cylinder, a polyhedron or even irregularly shaped. In such cases the sliding member 42 would be configured with a complimentary shape to accommodate such a blocking member. However preferably either the rear portion 41 of the hammer 18 or the protruding portion 49 of the blocking member that protrudes outside of the outer diameter of the driveshaft 10 should be configured such that movement of the hammer 18 in direction Y will cause the rear portion 41 to urge the blocking member to move inwardly towards the rotational axis 37 of the tool so that it can come into engagement with the sliding member 42 when such engagement is possible. Examples of two such arrangements are shown in FIGS. 9 and 10.

Absent the adjustment means which will be described in the following, the sliding member 42 is biased by the spring 46 so that it is in the position shown in FIG. 6. Under these circumstances, the balls 40 cannot enter groove 48 and so they are displaced by the sliding member 42 so that they protrude outwards from the outer circumference of the driveshaft 10. This effectively stops hammer 18 from travelling in direction Y. As such, the impact driver functions in drill mode (FIGS. 6-8).

Adjustment means which can be used to conveniently switch between these two modes will now be described. However, other methods may also be devised so long as they provide means for moving the sliding member 42 from its position relative to the driveshaft 10 in FIG. 6 to its position in FIG. 2.

The sliding member 42 can be accessed via adjustment means, preferably a pin 50 which is resident in a through-hole 52 in the sliding member 42. Each end 54 of the pin 50 passes through one of the two slots 56 in the driveshaft 10. The slots 56 are so shaped for allowing the pin ends 54 to move axially but not to rotate relative to the driveshaft 10. With this configuration, the sliding member 42 is also constrained from rotation, and as discussed previously this is relevant to the placement of recesses thereon. A slot shape is not required and alternatively shaped radial cavities such as a circular cavity are also contemplated that would still permit the pin ends 54 to rotate.

The pin 50 is longer than the internal diameter of a washer 58 (see FIG. 5), and so the ends of the pin rest against the surface of washer 58 under the force of the spring 46. There is space in the tool for the washer 58 to move axially (compare FIG. 2 with FIG. 6). The washer 58 is provided with two arms 60, although one, three, or four or more arms are also possible. The arms 60 interact with a user-rotatable sleeve 62 that is mounted to the outer surface of the tool housing 1 in the vicinity of the gearbox 8.

More specifically, the biasing force of spring 46 passes through sliding member 42 on to the pin 50 and then on to the washer 58 so that washer arms 60 are pressed against paired surfaces 64 on the sleeve 62 in drill mode. To switch to impact mode, the user rotates the sleeve 62, so that the washer arms 60 pass along cam surfaces 66 to counteract the force from spring 46. In this case, the arms 60 are pressed against paired surfaces 68. While the surfaces 64, 66, and 68 are present on the outer surface of the sleeve in the preferred embodiment, they may also be intrinsic to an enclosed slot as exemplified by slot 70.

While the pin 50 comprises adjustment means for adjusting the position of the sliding member 42, so too can the washer 58 (working through the pin 50) and the sleeve 62 (working through the washer 58 and the pin 50) be also considered adjustment means.

It is contemplated that the arrangement of many of the elements which interact with the sliding member 42 can be reversed. For example, rather than urge the sliding member 42 in direction Y, the spring 46 can be disposed so as to urge the sliding member in direction X, either by mounting this biasing member in a different location or by using a tension spring rather than a compression spring. When practicing this alternative, the surfaces 64, 66 and 68 of the sleeve 62 could be oriented as in a mirror image. For example they could be provided on the surface of the sleeve facing away from the working end of the tool so as to provide the proper force on the washer arms to overcome the force of the spring 46 on the sliding member 42.

Also, depending on the location of the circumferential groove 48 or recesses upon the sliding member 42, it could be that when the sliding member 42 is urged in direction Y, the balls 40 are received by the groove 48 and the tool operates in impact mode, and when the rotating sleeve 62 is used to urge the sliding member 42 in direction X, the balls are not received by the groove and the tool operates in drill mode.

The rotatable sleeve 62 may be simultaneously used to control other functions, for example through the use of a second cam surface 72 present in a slot 70 in the sleeve 62. One example of a further function would be a variable speed adjustment. For example, a pin coupled to the slot 70 in the sleeve 62 could be linked to one of the gears in the gearbox 8. Movement of the pin along the cam surface 72 of the sleeve 62 would bring the gear into and out of engagement with other gears as a means for providing different amounts of planetary gear reduction between the motor 4 and the driveshaft 10 and therefore providing alternative rotational speeds to the tool.

By varying the location of the cam surfaces 66 or 72 or by providing other cam surfaces that work in a contrary direction, the rotatable sleeve 62 can be imparted with unique combinations of functions at unique positions of rotation.

It is understood that alternatively shaped adjustment means may be provided instead of the pin 50 present in the preferred embodiment. Design alternatives include rectangular elements, pins or polygons with non-uniform widths, curved members, or irregularly shaped members. The shape of such design alternatives is not critical so long as the adjustment means move when the sliding member 42 is moved, pass through at least one cavity in the driveshaft 10 and can transmit a force to and receive a force from the washer 58.

Figure 11:
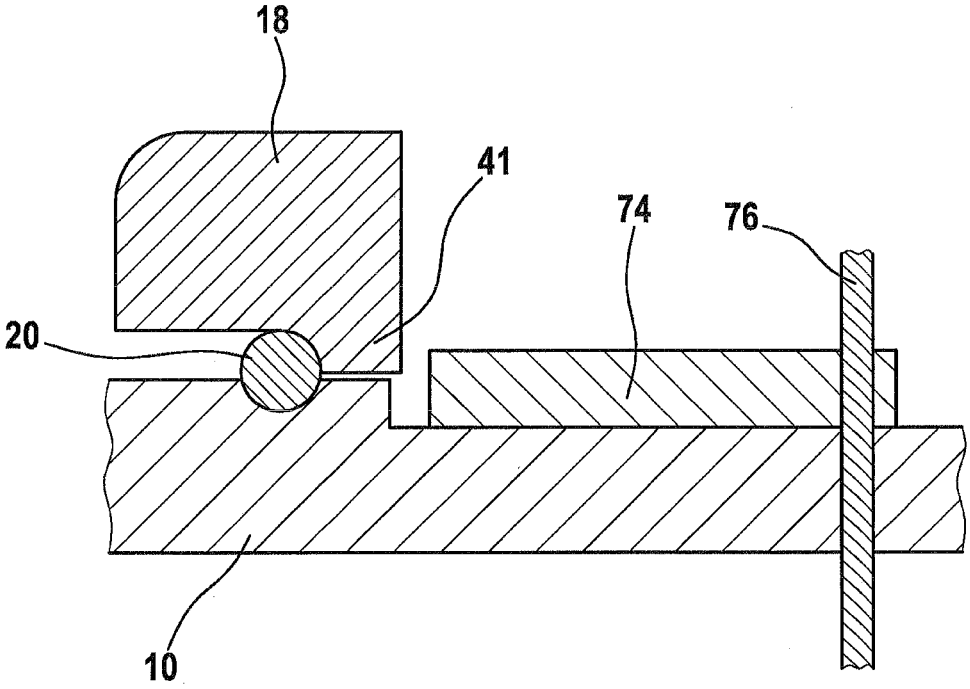
FIG. 11 is a schematic view of yet another alternative embodiment for an impact driver in impact mode which is comparable to the section view of FIG. 6.
Figure 12:
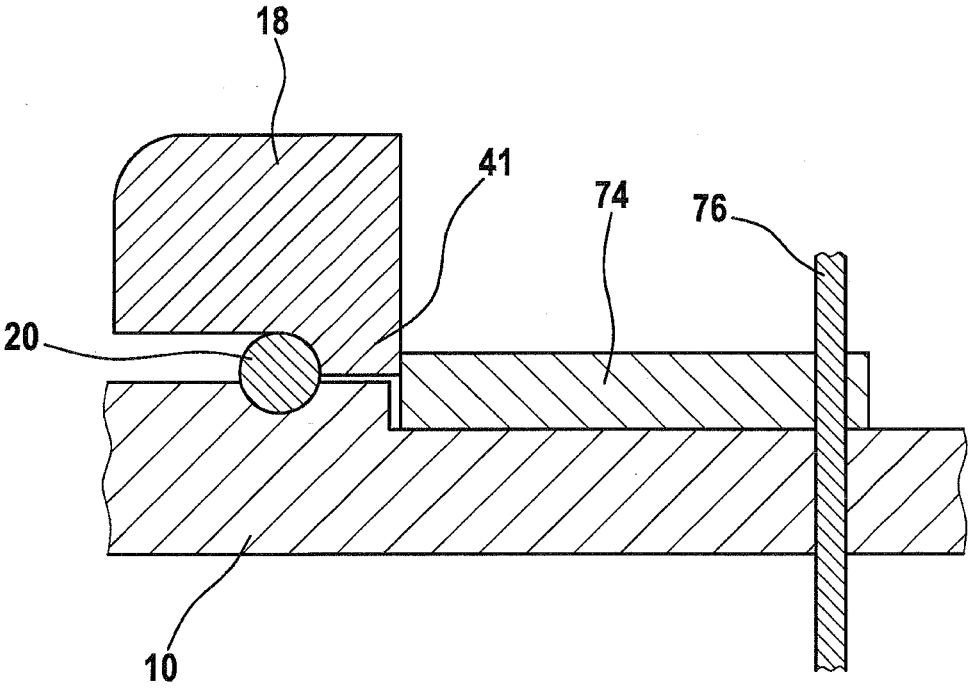
FIG. 12 is a schematic view of the FIG. 11 embodiment for an impact driver in drill mode which is comparable to the section view of FIG. 6.

An alternative embodiment in which the functions of the balls 40 and the sliding member 42 of the preferred embodiment are combined is illustrated in FIGS. 11 and 12. The blocking member in this representative embodiment is a rod 74 that is directly adjacent the driveshaft 10 and it is configured for being slidably adjustable into each of two positions. As in the preferred embodiment, the positions may be selected via movement of a pin 76 or by comparable adjustment means as described previously which is linked to the washer 58 and rotatable sleeve 62. More than one rod 74 is possible, and multiple rods 74 would be preferably arranged symmetrically so they could cooperate with the same pin 76. As an alternative to a rod 74, a sleeve structure fully surrounding portions of the driveshaft 10 may function in a like manner. In FIG. 11, the rod 74 is arranged via rotation of the sleeve 62 so that it does not block the movement of the hammer 18 and so the tool operates in impact mode. In FIG. 12, the rod 74 blocks movement of the hammer 18 and so the tool operates in drill mode. In switching between these modes, the rod 74 moves axially relative to the driveshaft 10.

In every embodiment herein described, the blocking member is somehow supported by the driveshaft 10. For example, when balls 40 or related alternatives are used, they are resident within radial cavities 38 present in the driveshaft 10, and so they are supported by the driveshaft 10. The rod 74 and the related variants are intended to move relative to the driveshaft 10, but the path of the movement is on, along, and adjacent to the driveshaft 10. In other words, the rod 74 is not isolated from the driveshaft 10, and is supported by it since it is at all times in close proximity to and preferably linked with the driveshaft 10 through the adjustment means.

Although the representative embodiments describe a mechanism for switching between impact mode and drill mode, it is also contemplated that blocking the progress of the hammer 18 as described in the foregoing description can be used for other purposes. For example, if a comparable tool were provided with a continuous percussion mode that is mediated by a similar hammer arrangement, then the present system might also be used enable and disable this mode.

The various embodiments and design alternatives described in the foregoing description can be built-in features of a rotary tool or alternatively the functional elements so described could comprise elements of an optional attachment for a rotary power tool that does not have an impact function. Ways for compartmentalizing these functions into a separate attachment has been shown previously, for example in U.S. Pat. No. 5,992,538. Such an attachment would look similar to the portion of the impact driver 2 illustrated in FIG. 4, albeit further configured for engagement with the working end of a drill/driver.

The invention claimed is:

1. A rotary power tool operable in either an impact mode or a drill mode comprising:

a driveshaft (10) configured to rotate about a rotational axis (37);

an output shaft (32);

a hammer (18) coupled to the driveshaft (10) for transmitting torque to the output shaft (32); and a blocking member (40) which is in a first position wherein it blocks the hammer (18) from moving axially along the rotational axis (37) of the power tool when the power tool operates in the drill mode and is in a second position wherein it allows the hammer (18) to move axially along the rotational axis (37) of the power tool when the power tool operates in the impact mode, wherein the blocking member (40) is supported by the driveshaft (10), and wherein in order to move between the first position and the second position, the blocking member (40) performs a linear movement in a radially inward direction relative to the rotational axis (37) of the tool defined by the driveshaft (10), wherein the blocking member (40) is arranged in a radial cavity (38) in the driveshaft (10).

2. A rotary power tool according to claim 1, characterized in that in order to move between the first position and the second position, the blocking member (74) moves axially relative to the driveshaft (10).

3. The rotary power tool according to claim 1, wherein a portion (41) of the hammer (18) retains the blocking member (40) in the radial cavity (38).

4. A rotary power tool operable in either an impact mode or a drill mode comprising:

a driveshaft (10);

an output shaft (32);

a hammer (18) coupled to the driveshaft (10) for transmitting torque to the output shaft (32); and a blocking member (40) which is in a first position wherein it blocks the hammer (18) from moving axially along the rotational axis (37) of the power tool when the power tool operates in the drill mode and is in a second position wherein it allows the hammer (18) to move axially along the rotational axis (37) of the power tool when the power tool operates in the impact mode, wherein the blocking member (40) is supported by the driveshaft (10), and wherein in order to move between the first position and the second position, the blocking member (40) moves radially relative to the driveshaft (10), wherein a sliding member is mounted within an axial cavity in the driveshaft, wherein the sliding member comprises at least one recess configured to accommodate the blocking member when the blocking member is in the second position.

5. The rotary power tool as defined in claim 4, wherein the at least one recess is embodied as a circumferential groove.

6. The rotary power tool as defined in claim 1, wherein the blocking member is embodied as a ball.

7. A rotary power tool operable in either an impact mode or a drill mode comprising:

a driveshaft (10);

an output shaft (32);

a hammer (18) coupled to the driveshaft (10) for transmitting torque to the output shaft (32); and a blocking member (40) which is in a first position wherein it blocks the hammer (18) from moving axially along the rotational axis (37) of the power tool when the power tool operates in the drill mode and is in a second position wherein it allows the hammer (18) to move axially along the rotational axis (37) of the power tool when the power tool operates in the impact mode, wherein the blocking member (40) is supported by the driveshaft (10), and wherein in order to move between the first position and the second position, the blocking member (40) moves radially relative to the driveshaft (10), wherein a sliding member is mounted within an axial cavity in the driveshaft, wherein adjustment means urge the sliding member into either a first sliding position in which the blocking member is displaced into the first position or a second sliding position in which the blocking member is in the second position and is in contact with a recess in the sliding member, wherein the adjustment means includes a pin which resides in a through-hole in the sliding member.

8. The rotary power tool as defined in claim 7, wherein each end of the pin passes through one of two slots in the driveshaft.

9. The rotary power tool as defined in claim 7, wherein the ends of the pin rest against a washer under the force of the biasing member.

10. The rotary power tool as defined in claim 9, wherein the washer includes at least one arm which interacts with a user-rotatable sleeve.

11. A rotary power tool according to claim 1, wherein a sliding member is mounted within an axial cavity in the driveshaft.

12. A rotary power tool according to claim 11, wherein when the sliding member is in a first sliding position, the blocking member is displaced into the first position.

13. A rotary power tool operable in either an impact mode or a drill mode comprising:

a driveshaft (10);

an output shaft (32);

a hammer (18) coupled to the driveshaft (10) for transmitting torque to the output shaft (32); and a blocking member (40) which is in a first position wherein it blocks the hammer (18) from moving axially along the rotational axis (37) of the power tool when the power tool operates in the drill mode and is in a second position wherein it allows the hammer (18) to move axially along the rotational axis (37) of the power tool when the power tool operates in the impact mode, wherein the blocking member (40) is supported by the driveshaft (10), and wherein in order to move between the first position and the second position, the blocking member (40) moves radially relative to the driveshaft (10), wherein a sliding member is mounted within an axial cavity in the driveshaft, wherein when the sliding member is in a second sliding position, the blocking member is in the second position and is in contact with a recess in the sliding member.

14. A rotary power tool according to claim 11, wherein a biasing member urges the sliding member into either a first sliding position in which the blocking member is displaced into the first position or a second sliding position in which the blocking member is in the second position and is in contact with a recess in the sliding member.

15. A rotary power tool according to claim 11, wherein adjustment means urge the sliding member into either a first sliding position in which the blocking member is displaced into the first position or a second sliding position in which the blocking member is in the second position and is in contact with a recess in the sliding member.

16. A rotary power tool according to claim 15, wherein the adjustment means also adjusts the rotational speed of the driveshaft.

17. The rotary power tool as defined in claim 1, wherein the blocking member is supported axially by the walls of the radial cavity.

18. The rotary power tool as defined in claim 11, wherein the blocking member is retained by the sliding member.

19. The rotary power tool as defined in claim 11, wherein when the sliding member is in a second sliding position, the blocking member is in the second position and is at least partially received in the recess in the sliding member.

* * * * *